US005802683A

United States Patent [19]

Curran et al.

[11] Patent Number: 5,802,683

[45] Date of Patent: Sep. 8, 1998

[54] METHOD FOR MAKING UNBULKED THREAD

[75] Inventors: William Wingate Curran; John Aitken, both of Paisley, Great Britain

[73] Assignee: J. & P. Coats, Limited, Glasgow, Great Britain

[21] Appl. No.: 646,342

[22] Filed: Apr. 18, 1997

[30] Foreign Application Priority Data

Nov. 13, 1993 [GB] United Kingdom ..... 9323439

[51] Int. Cl.[6] ..... D02G 1/20; D02J 1/22

[52] U.S. Cl. ..... 28/220; 24/240

[58] Field of Search ..... 28/240, 243, 244, 28/245, 246, 220, 271

[56] References Cited

U.S. PATENT DOCUMENTS

| | | | |
|---|---|---|---|
| 4,319,447 | 3/1982 | Barron | 28/220 |
| 4,437,301 | 3/1984 | Eschenbach et al. | 28/220 |
| 4,497,099 | 2/1985 | Scott | 2/220 |
| 4,571,793 | 2/1986 | Price | 28/220 |
| 5,359,759 | 11/1994 | Jacob et al. | 28/220 |
| 5,581,858 | 12/1996 | Curran et al. | 28/220 |

FOREIGN PATENT DOCUMENTS

| | | | |
|---|---|---|---|
| 057053 | 8/1982 | European Pat. Off. | 28/220 |
| 352376 | 1/1990 | European Pat. Off. | 28/220 |

*Primary Examiner*—C. D. Crowder
*Assistant Examiner*—Larry D. Worrell, Jr.
*Attorney, Agent, or Firm*—Kenneth C. Hill

[57] ABSTRACT

A method for making a thread comprising: feeding at least two drawn, continuous filament starting threads (18, 19), of which at least one is a multi-filament thread, together to an intermingling device (21) to form a single bulked thread of which the filaments of the starting threads are intermingled and looped, and applying a bulk-reducing treatment to the bulked thread characterized in that the bulk-reducing treatment comprises a treatment under tension without the thread being heated.

20 Claims, 1 Drawing Sheet

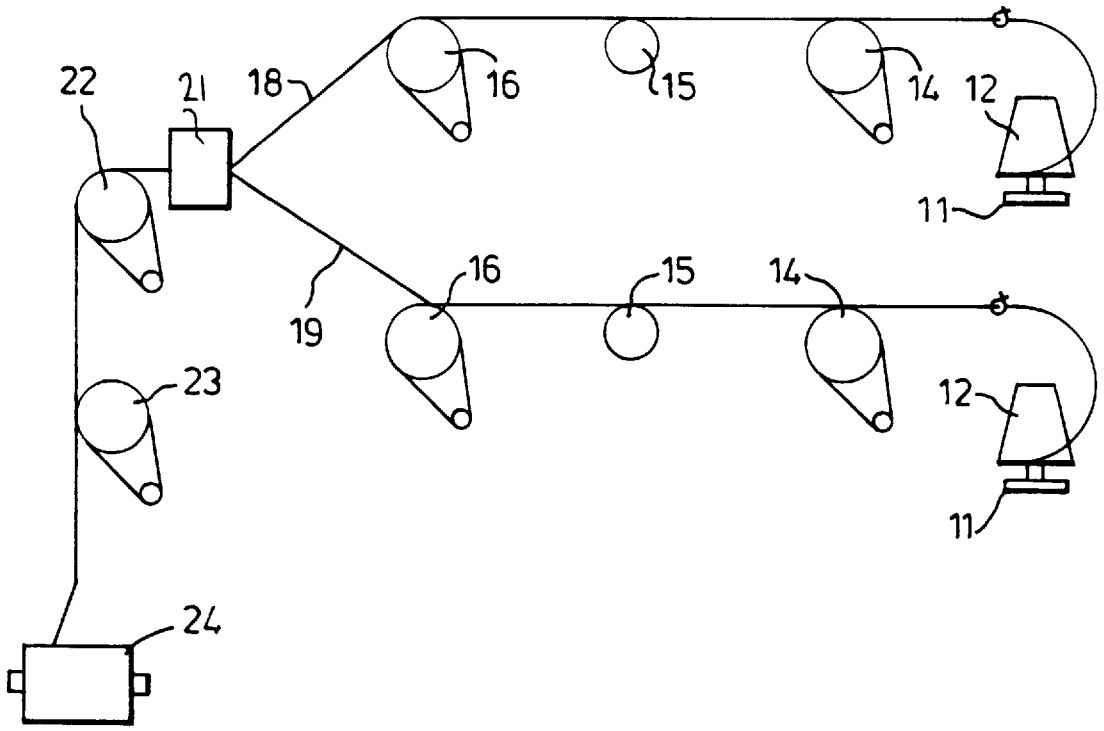
22
21
18
16
15
14
12
11
19
16
15
14
12
11
23
24

METHOD FOR MAKING UNBULKED THREAD

BACKGROUND OF THE INVENTION

1. Field of the Invention

This invention relates to making thread.

2. Description of Related Art

EP-0 057 583 discloses a method for making a textile strand involving differentially overfeeding two separate filamentous strands to a jet device which commingles and interlaces and forms loops in the filaments of the strands and then subjecting the commingled strand to a heating step in which loops formed by the jet are pulled and in so doing tighten any entanglements present as a result of the jet treatment and thus consolidate the strand. A "twistless" sewing thread can be produced in this way, "twistless" implying not that the thread is without twist, because twist can always be added, but rather that the thread has been produced without the need for twisting which is implicit in the production of sewing thread from staple fibre such as cotton.

The method of EP-0 057 583 involves feeding at least two strands to an intermingling device (in the form of a texturing jet) to create a single, intermingled textured yarn which is characterized by projecting filament loops and subsequently heat treating the intermingled, textured yarn to eliminate its bulkiness.

It has now been found that the method of EP-0 057 583 can be modified to yield further cost savings and/or other advantages over the prior art methods of sewing thread production, which modifications will also be useful in connection with other yarns or threads that can be produced by the process of EP-0 057 583 and in extending the range of yarns that can be produced using techniques described therein.

U.S. Pat. No. 4,319,447, considered to represent the closest prior art, discloses a method wherein a core yam and an effect yam are differentially overfed to a jet device, and the combined core-and-effect yarn tensioned. However, the method of U.S. Pat. No. 4,319,447, is directed towards the production of bulky yarn.

SUMMARY OF THE INVENTION

The invention comprises a method for making a thread comprising: feeding at least two drawn, continuous filament starting yarns, of which at least one is a Depending upon the speed of operation and the processing machine configuration, the heat applied to the yarns before the air jet will dissipate up to and beyond the air jet, but the thread emerging from the air jet may still be at an elevated temperature as compared to ambient.

By "without the thread being heated" is not to be understood that the thread is not at some elevated temperature above ambient, rather that no effective heat treatment is to be deliberately applied to the thread. Essentially, if a thread is heat set, it requires to be subjected to a temperature regime more effective than the heat setting regime if the properties of the thread are to be substantially altered. Heat setting is normally carried out at a temperature in excess of anything the thread (as thread or in fabric) will ordinarily experience in further processing or in use (in laundering, for example). The application, for whatever reason, of a heat treatment which was under conditions of temperature, time and tension collectively less severe than the heat setting treatment before the jet, would not be regarded for present purposes as a heat treatment. Thus if a heat setting treatment had been carried out before the jet at a temperature of 220° C., a subsequent yarn temperature after the jet of 150° C. (whether by virtue of heat remaining in the thread from the heat setting treatment or of applied heat after the jet) would not be regarded, for present purposes, as a heat treatment.

By "treatment under tension" is meant treatment under any tension above zero tension and up to the point where the process becomes impossible to operate by virtue of threadline instability or thread or filament breakage. Tension is applied in thread processing by underfeeding a yarn or thread and underfeeding can be at different rates from just over zero underfeed up to several percent so as to keep the threadline taut and stable at low underfeeds, to stretch the thread elastically at higher underfeeds or to stretch the thread inelastically at still higher underfeeds.

The surprising thing is that even at nominal zero overfeed (just sufficient to keep the thread taut), without the application of any heat, after the jet, the thread is tightened usefully so that it will even meet quite well the exacting requirements for a sewing thread, and this is surprising in view of the widespread acceptance of the need for post-jet heat as taught in EP-0 057 583.

BRIEF DESCRIPTION OF THE DRAWINGS

Methods for making threads according to the invention will now be described with reference to the accompanying drawings, in which the single FIGURE is a diagrammatic illustration of an apparatus for producing thread.

DETAILED DESCRIPTION OF THE INVENTION

The apparatus illustrated in the FIGURE comprise supports 11 for a pair of yarn supply packages 12 and for each support 11 a drawing arrangement 13 comprising a first godet 14, a heatable draw pin 15 and a second, heatable godet 16.

The two starting threads 18,19 are fed to an airjet intermingling device 21 such as a Heberlein T300 Series or a Du Pont Mk XV jet.

The intermingled, bulked thread is withdrawn from the jet 21 by a godet 22 and passes to a further godet 23 which runs faster than the godet 22 to extend the thread, thence to a wind-up arrangement 24.

It is to be understood that the arrangement thus described is a comprehensive arrangement, individual items of which may be by-passed (and, in an industrial operation, therefore, omitted altogether to simplify the machinery and keep its capital cost as low as possible) or, in the case of heatable components such as draw pins and godets, left unheated (so that, again for an industrial operation, an unheated version of the component would be used).

Further, it should be understood that suitable drive means will be used allowing the various rolling components to be driven at any desired speed (though again such provision for variable speed need not be carried through to an industrial machine intended to make one specification of thread only) and suitable temperature control means will be available for the heated components.

The apparatus facilitates various methods of thread production within the scope of the invention, namely by feeding at least two drawn, continuous filament starting yarns 18,19 together to the intermingling device 21 to form a single bulked thread of which the filaments of the two starting yarns 18,19 are intermingled and looped, and applying a bulk-reducing treatment to the bulked thread 27 which comprises a treatment under tension without the thread 27 being heated.

The starting yams may be of polyester POY 312 F48 as core 18 and 80 F 24 as effect yarn 19. The core yarn 18 may be overdrawn at a draw ratio of 2.2:1 (as compared to the normal draw ratio of 1.7:1 specified for such yarn) while the effect yarn 19 may be overdrawn at a draw ratio of 1.83:1.

One or both starting yarn can be hot drawn. The core yarn 18 can be drawn without using the hot pin 15 but using a heated godet 16; the effect yarn 19 can be drawn using the hot draw pin 15 but with the godet 16 cold.

The two drawn starting yarns can then be overfed to the air jet 21, the core yarn 18 at 7.5% overfeed, the effect yarn at 30% overfeed.

In a different process, the core yarn 18 can be cold drawn, and then overfed at 4.5% to the air jet 21.

These overfeeds are, of course, the relationships between the speeds of the godets 16 and that of the godet 22.

The bulked thread 27 is underfed from godet 22 to godet 23 so as to produce an unrecovered extension of the thread. This treatment tightens the thread from the air jet 21 whilst retaining its intermingled structure, essentially reducing the size of the filament loops so that the thread becomes an essentially unbulked thread which is cohesive in the sense that its filaments do not tend to fly apart and which to all intents and purposes can be used exactly as spun thread (after such finishing treatments as are appropriate, which may include the application of a lubricant and the insertion of twist, the latter being required for some purposes at a much lower level that for conventionally spun yarn, rather as a means of helping to maintain an essentially circular cross-section when the thread is running over an edge or surface as in sewing).

As mentioned, variations can be made to the method and to the apparatus for the production of specific types of thread, starting from different raw materials. In particular, sewing threads having excellent properties both as to tenacity and as to low occurrence of breaks in long run and multidirectional sewing can be produced at a substantially lower cost than spun threads conventionally used for sewing.

We claim:

1. A method for making a thread comprising:

feeding at least two drawn, continuous filament starting threads, of which at least one is a multifilament thread, together to an intermingling device to form a single bulked thread of which the filaments of the starting threads are intermingled and looped, and tensioning the bulked thread without heat, the tensioning being sufficient to transform the bulked thread into an essentially unbulked thread.

2. A method according to claim 1, characterized in that the intermingling device (21) is an air jet device.

3. A method according to claim 1, in which at least one of the starting threads (18,19) is overdrawn.

4. A method according to claim 1, in which one of the starting threads (18,19) is drawn to a different draw ratio than the other or others of the starting threads (18,19).

5. A method according to claim 1, in which at least one of the starting threads (18,19) is hot drawn.

6. A method according to claim 1, in which at least one of the starting threads (18,19) is cold drawn.

7. A method according to claim 1, in which at least one of the starting threads (18,19) is drawn continuously with its overfeeding to the intermingling device (21).

8. A method according to claim 7, in which at least one starting thread (18,19) is overfed to the intermingling device at a different rate of overfeed to the other thread or threads (18,19).

9. A method according to claim 1, in which the tensioning comprises an underfeeding operation.

10. A method according to claim 9, in which the underfeeding operation produces an unrecovered extension.

11. A method for making a thread comprising:

feeding at least two drawn, continuous filament starting threads, of which at least one is a multifilament thread, together to an intermingling device to form a single bulked thread of which the filaments of the starting threads are intermingled and looped, and tensioning the bulked thread without heat, the tensioning being sufficient to produce an unrecovered extension.

12. The method according to claim 11, wherein the tensioning is sufficient to transform the bulked thread into an unbulked thread.

13. The method according to claim 11, wherein the intermingling device is an air jet device.

14. The method according to claim 11, in which at least one of the starting threads is overdrawn.

15. The method according to claim 11, in which one of the starting threads is drawn to a different draw ratio than the other or others of the starting threads.

16. The method according to claim 11, in which at least one of the starting threads is hot drawn.

17. The method according to claim 11, in which at least one of the starting threads is cold drawn.

18. The method according to claim 11, in which at least one of the starting threads is drawn continuously with overfeeding to the intermingling device.

19. The method according to claim 11, in which at least one starting thread is overfed to the intermingling device at a different rate of overfeed than the other thread or threads.

20. The method according to claim 11, in which the tensioning comprises an underfeeding operation.

* * * * *